US012628937B2

(12) United States Patent
Huang

(10) Patent No.: US 12,628,937 B2
(45) Date of Patent: May 19, 2026

(54) HANGABLE SHEATH ASSEMBLY

(71) Applicant: INDUSTRO INTERNATIONAL CO., LTD., Taichung City (TW)

(72) Inventor: Kuo-Chan Huang, Taichung City (TW)

( * ) Notice: Subject to any disclaimer, the term of this patent is extended or adjusted under 35 U.S.C. 154(b) by 219 days.

(21) Appl. No.: 18/387,436

(22) Filed: Nov. 6, 2023

(65) Prior Publication Data

US 2025/0143442 A1 May 8, 2025

(51) Int. Cl.
*A45F 5/02* (2006.01)
*A45F 5/00* (2006.01)

(52) U.S. Cl.
CPC ..... *A45F 5/021* (2013.01); *A45F 5/1575* (2025.01)

(58) Field of Classification Search
CPC .. A45F 5/021; A45F 5/1575; A45F 2005/026; B62B 29/025; B62B 29/02; B65D 25/22; B65D 73/0064
USPC ..... 248/322
See application file for complete search history.

(56) References Cited

U.S. PATENT DOCUMENTS 4,044,933 A * 8/1977 Artz ..... A45F 5/02 224/666
5,031,810 A * 7/1991 Finn ..... B26B 29/025 224/232
D508,317 S * 8/2005 Kanzawa ..... D3/220
2016/0016272 A1* 1/2016 Chen ..... B26B 29/025 206/349

* cited by examiner

*Primary Examiner* — Adam J Waggenspack
(74) *Attorney, Agent, or Firm* — BruceStone LLP; Joseph A. Bruce

(57) ABSTRACT

A hangable sheath assembly includes a sheath and a hanger. The sheath includes a space, an opening in communication with the space, an edge extending around the opening, a wing extending from the edge, and a slot in the wing. The hanger includes an anchor inserted in the slot. The anchor includes a barb for abutment against the wing to keep the anchor in the slot, thereby keeping the hanger on the sheath.

10 Claims, 9 Drawing Sheets

HANGABLE SHEATH ASSEMBLY

BACKGROUND OF INVENTION

1. Field of Invention

The present invention relates to a sheath for a blade and, more particularly, to a hangable sheath assembly.

2. Related Prior Art

A sheath is used to contain a cutter such as pair of scissors or a knife. Thus, a user is allowed to carry the cutter without any risks of the cutter damaging anything or hurting anyone.

Taiwanese Patent No. M319139 discloses a cutter including pair of scissors 10 and a knife 20. The knife 20 includes a sheath 21, a locating element 22 and a blade 23. The blade 23 is connected to the locating element 22 that is movable along the sheath 21. The sheath 21 is operable to receive the blade 23 and the pair of scissors 10. The pair of scissors 10 and the blade 23 do not interfere with each other in use.

The present invention is therefore intended to obviate or at least alleviate the problems encountered in the prior art.

SUMMARY OF INVENTION

It is the primary objective of the present invention to provide a hangable sheath assembly.

To achieve the foregoing objective, the hangable sheath assembly includes a sheath and a hanger. The sheath includes a space, an opening in communication with the space, an edge extending around the opening, a wing extending from the edge, and a slot in the wing. The hanger includes an anchor inserted in the slot. The anchor includes a barb for abutment against the wing to keep the anchor in the slot, thereby keeping the hanger on the sheath.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
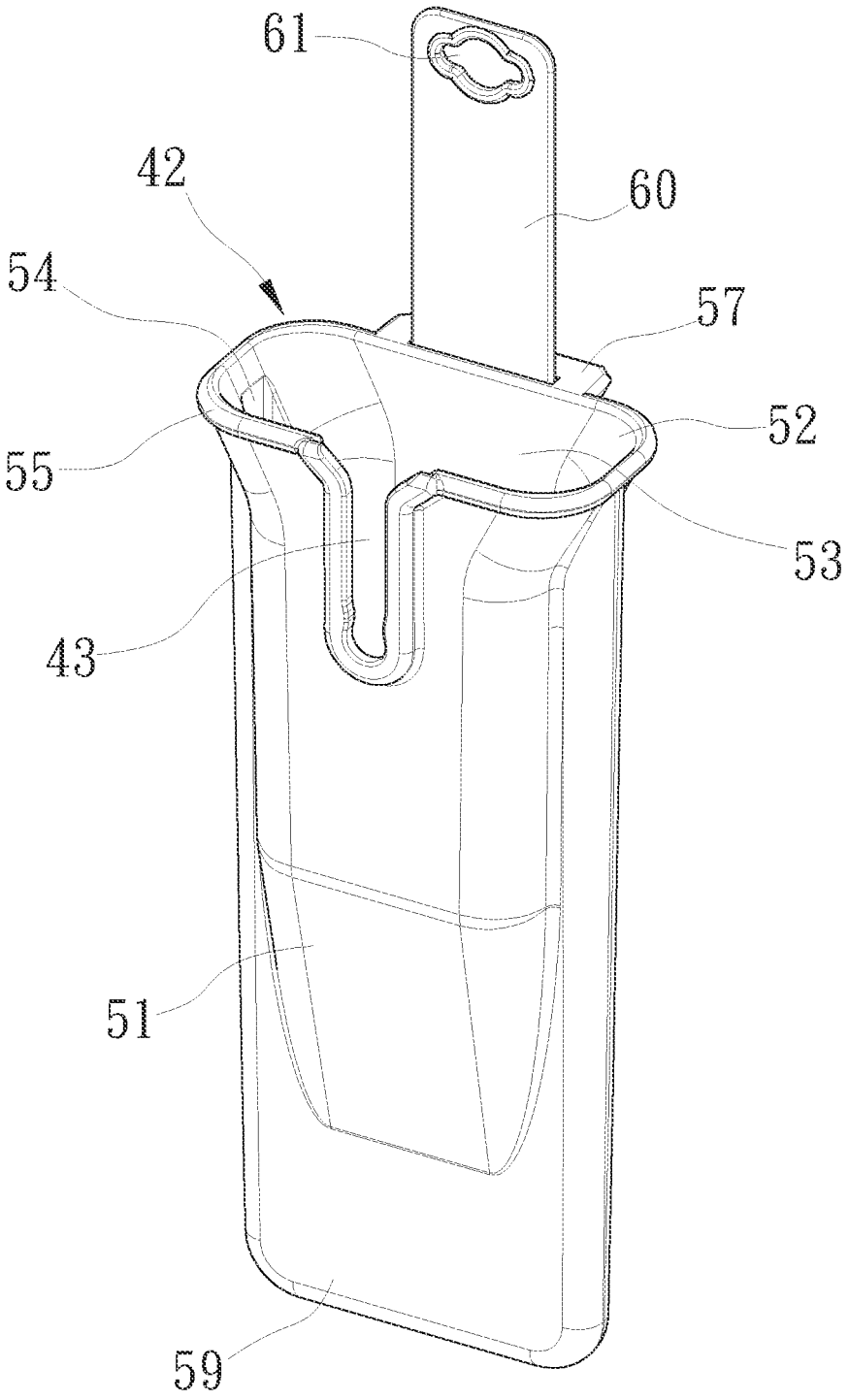
FIG. 1 is a perspective view of a hangable sheath assembly according to the preferred embodiment of the present invention.

Referring to FIG. 1, a hangable sheath assembly 42 includes a sheath 51 and a hanger 60 according to the preferred embodiment of the present invention. The sheath 51 includes a front portion (not numbered), a rear portion (not numbered) and two lateral portions (not numbered). The sheath 51 includes an opening 52 in communication with a space 53. The sheath 51 includes an edge 55 extending around the opening 52 and a wing 57 extending from the edge 55. The hanger 60 is connected to the wing 57. The hanger 60 includes an aperture 61 for receiving a hook, a nail or any other proper element so that the hangable sheath assembly 42 is hung on the hook or nail.

Figure 6:
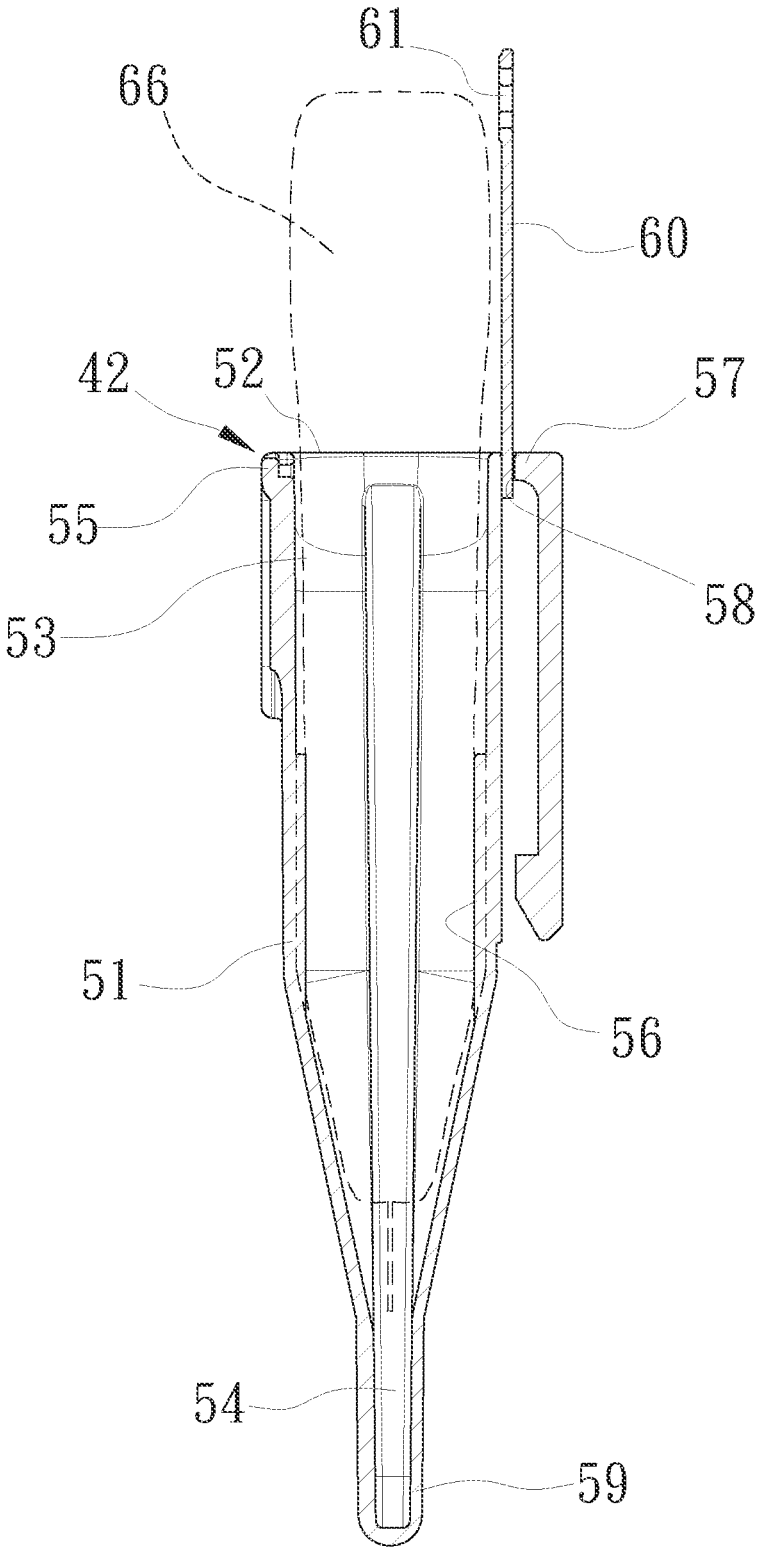
FIG. 6 is another cross-sectional view of the hangable sheath assembly shown in FIG. 1.

Referring to FIG. 6, a cutter 66 is insertable into the space 53 through the opening 52 for storage and carriage. The cutter 66 is movable from the space 53 through the opening 52 for use.

Figure 2:
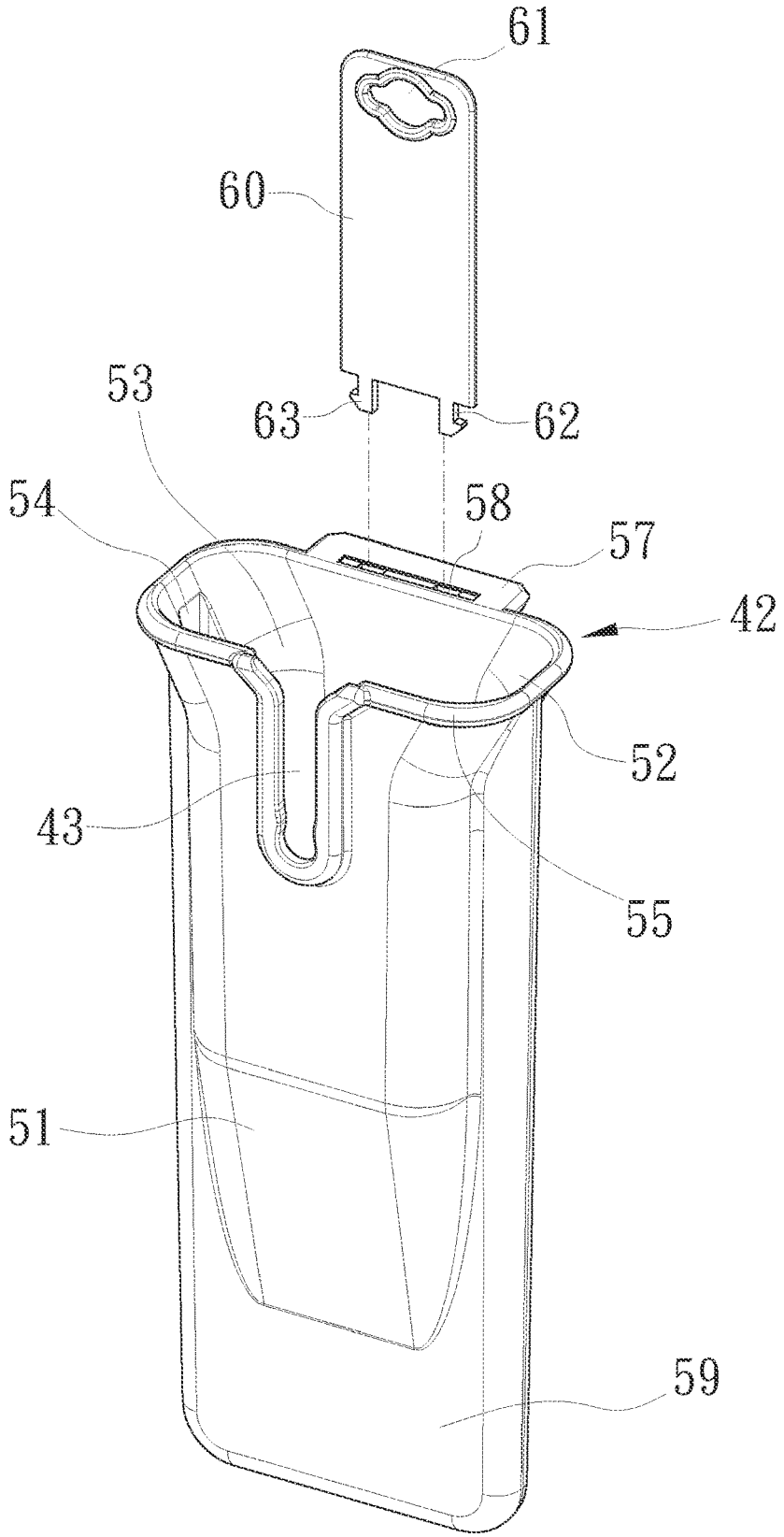
FIG. 2 is an exploded view of the hangable sheath assembly shown in FIG. 1.

Referring to FIG. 2, the hanger 60 is detached from the wing 57. The wing 57 includes two slots 58. The hanger 60 includes two anchors 62. Each of the anchors 62 is formed with a barb 63.

Figure 3:
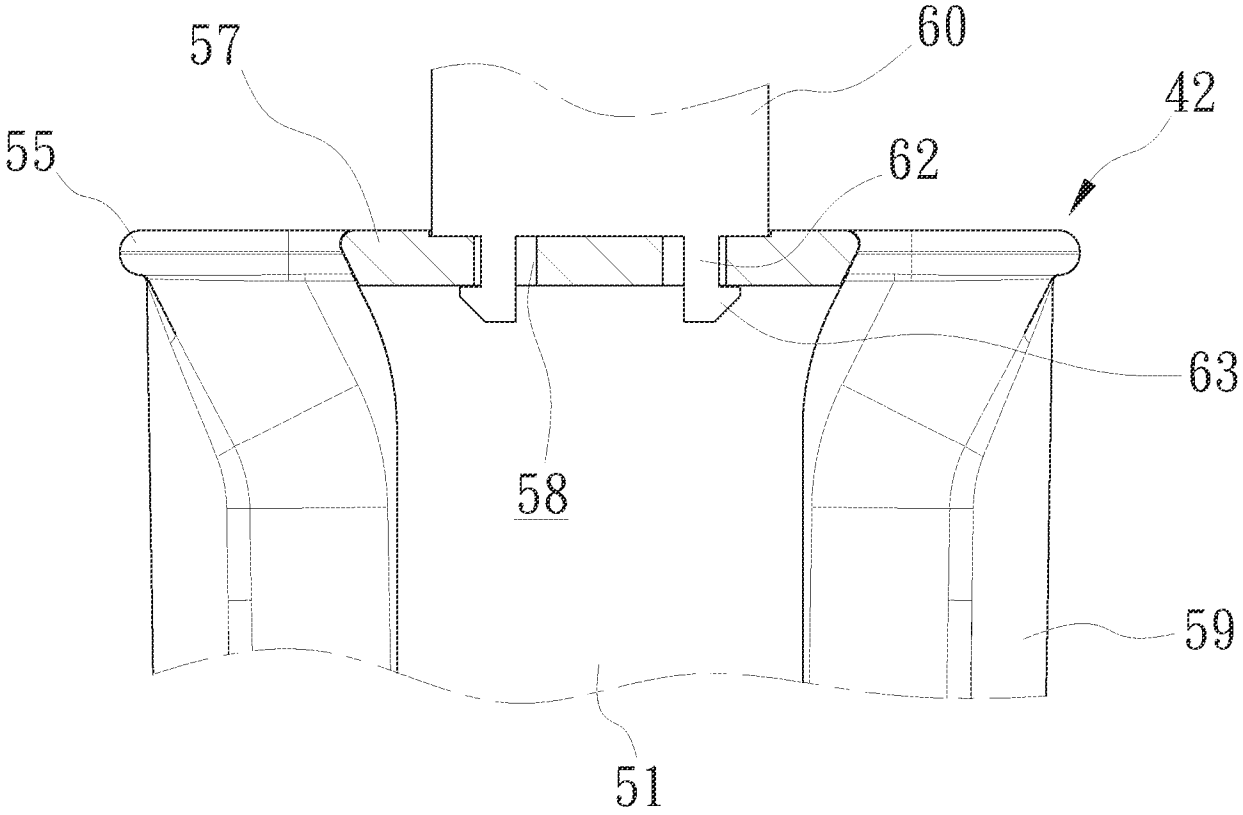
FIG. 3 is a cross-sectional view of the hangable sheath assembly shown in FIG. 1.

Referring to FIG. 3, the two anchors 62 are inserted in slots 58. The barbs 63 abut against a lower face of the wing 57 to keep the anchors 62 in the slots 58, i.e., to keep the hanger 60 on the wing 57 of the sheath 51.

Figure 4:
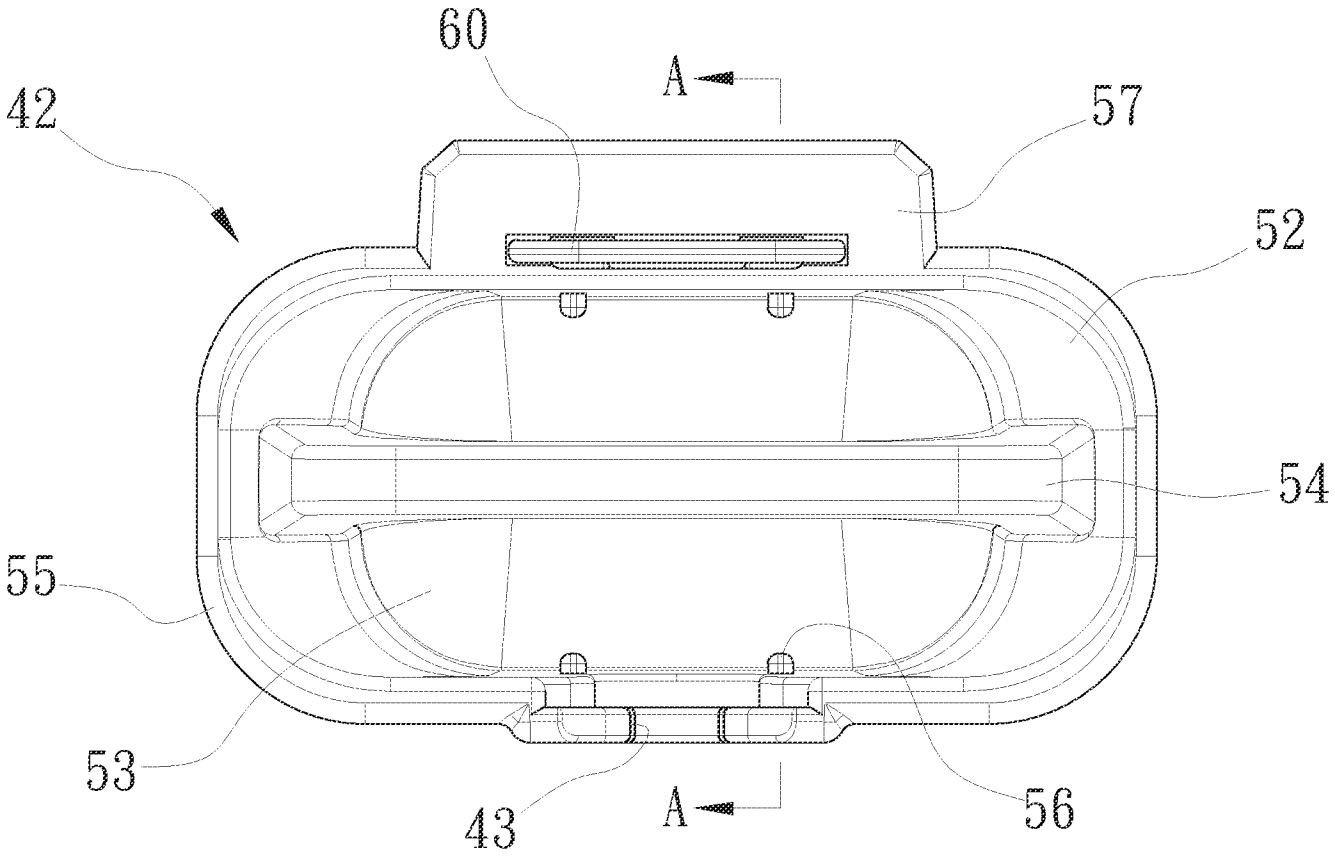
FIG. 4 is a cross-sectional view of the hangable sheath assembly shown in FIG. 1.

Referring to FIG. 4, two front reinforcement elements 56 extend on an internal face of the front portion of the sheath 51. Two rear reinforcement elements 56 extend on an internal face of the rear portion of the sheath 51. Each of the front reinforcement elements 56 is aligned to a corresponding one of the rear reinforcement elements 56. A groove 54 is made in an internal face of each of the lateral portions of the sheath 51. The space 53 is located between and in communication with the grooves 54.

Figure 5:
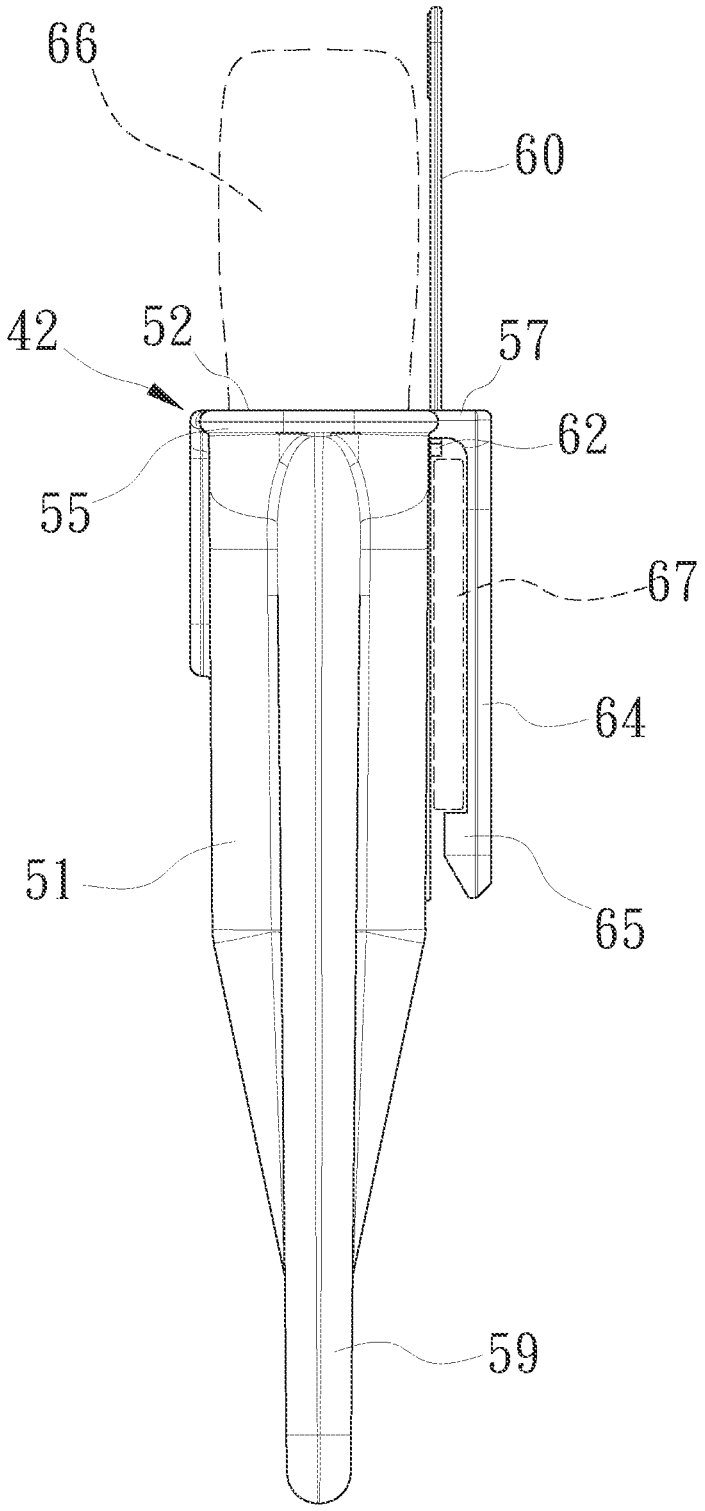
FIG. 5 is a side view of the hangable sheath assembly shown in FIG. 1.

Referring to FIGS. 5 and 6, the front reinforcement elements 56 are in contact with a front face of the cutter 66 inserted in the sheath 51 while the rear reinforcement elements 56 are in contact with a rear face of the same. Thus, the cutter 66 is firmly inserted in the sheath 51 by the reinforcement elements 56.

The sheath 51 includes a reinforcement portion 59 that is a U-shaped portion extending on external faces of the lateral portions of the sheath 51 and a closed end of the sheath 51, which is located opposite to the opening 52. Each of the grooves 54 extends in an internal face of a vertical section of the reinforcement portion 59 of the sheath 51. The grooves 54 receive cutting edges of the cutter 66. The reinforcement fin 59 prevents the cutting edges of the cutter 66 from cutting through the sheath 51.

The sheath 51 further includes a clip 64. The clip 64 extends from a lower face of the wing 57. There is a gap between the rear portion of the sheath 51 and the clip 64. The gap is used to receive a belt 67. The clip 64 preferably includes a barb 65 extending toward the rear portion of the sheath 51. The barb 65 can abut against a lower edge of the belt 67 to keep the belt 67 in the gap, i.e., to keep the hangable sheath assembly 42 on the belt 67.

Figure 7:
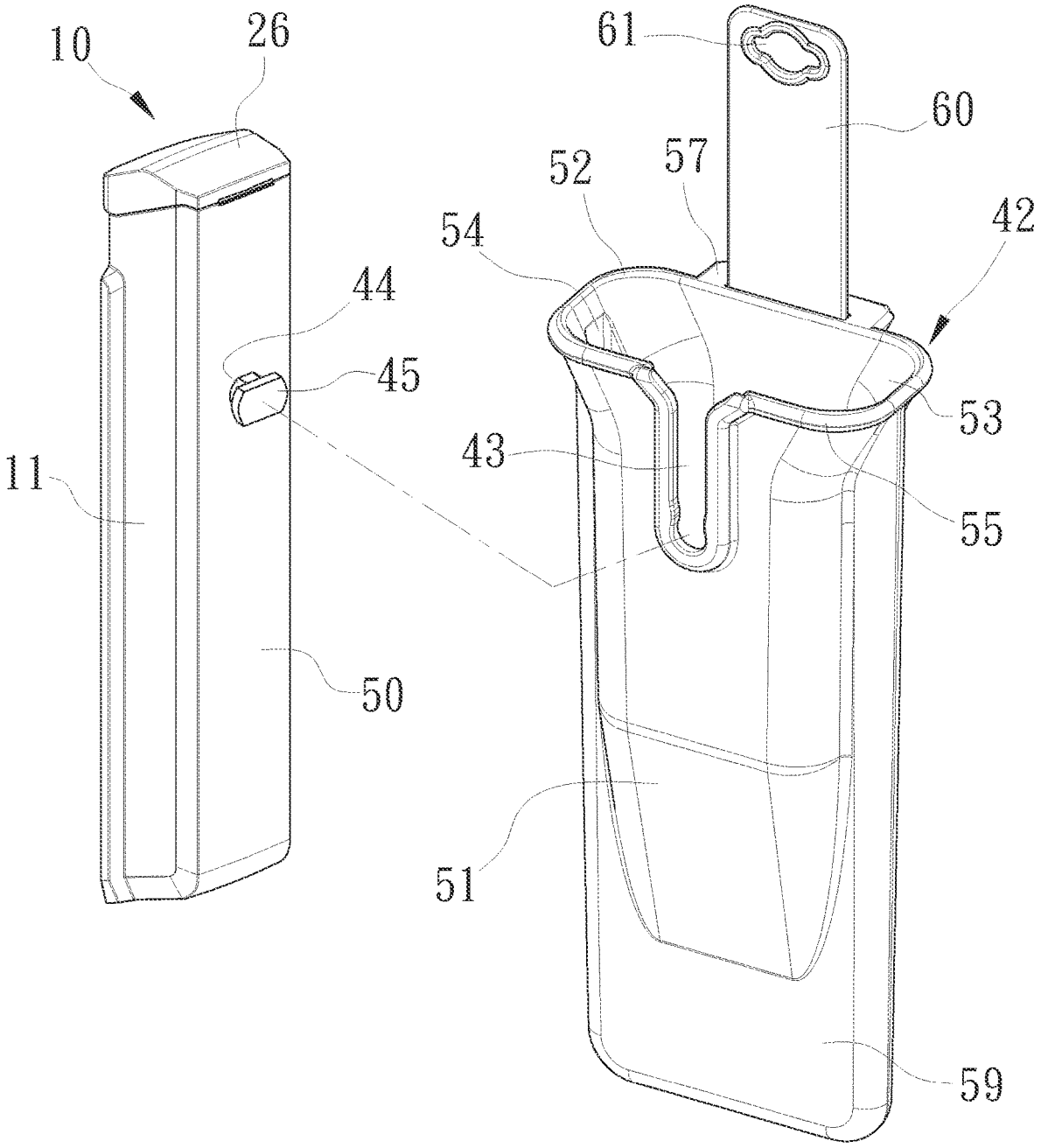
FIG. 7 is a perspective view of a blade container and the hangable sheath assembly shown in FIG. 1.

Referring to FIG. 7, the hangable sheath assembly 42 includes a blade container 10. The blade container 10 includes a box 11 connected to a lid 26. The box 11 is used to receive blades (not shown). The lid 26 is used to close an open end of the box 11. The lid 26 is movable from the box 11 to allow the blade to be moved from the box 11. The blade container 10 is deemed an accessory of the hangable sheath assembly 42 to enable the hangable sheath assembly 42 to contain blades of utility cutters (or "box cutters").

The box 11 includes a neck 44 on a rear portion 50 of the box 11 and a head 45 on the neck 44. Preferably, the neck 44 is a circular stem. Preferably, the head 45 is a substantially rectangular flat portion with two ends extending beyond the neck 44. In another embodiment, the head 45 can however be a disc with a diameter larger than that of the neck 44.

The blade container 10 is engageable with the sheath 51. The sheath 51 includes a slit 43 for receiving the neck 44 so that the box 11 is smoothly hung on the sheath 51. The head 45 is inserted in the sheath 51 while the box 11 is located out of the sheath 51. The blade container 10 can easily be moved from the sheath 51 for use.

Figure 8:
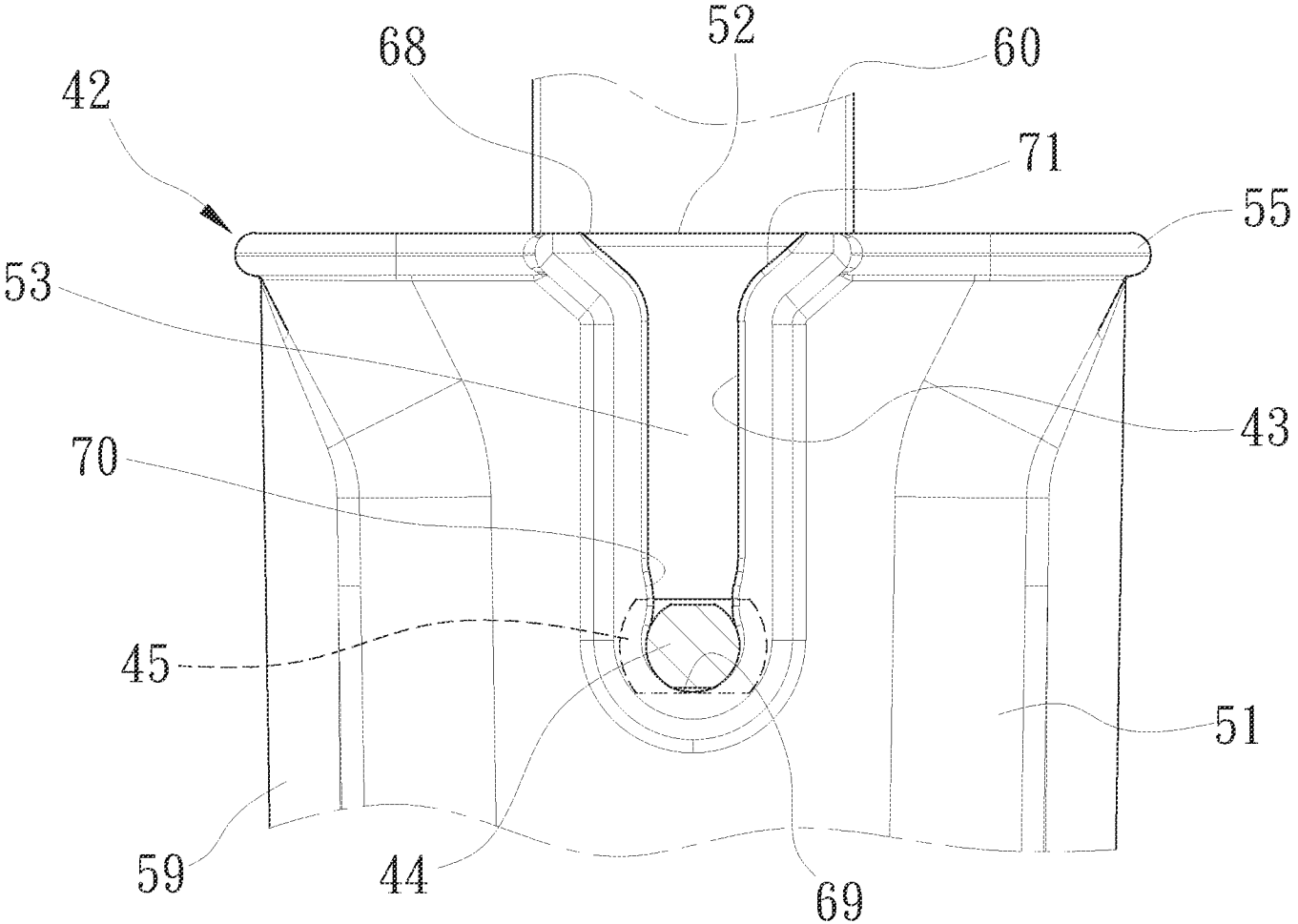
FIG. 8 is a front view of the blade container and the hangable sheath assembly shown in FIG. 7.
Figure 9:
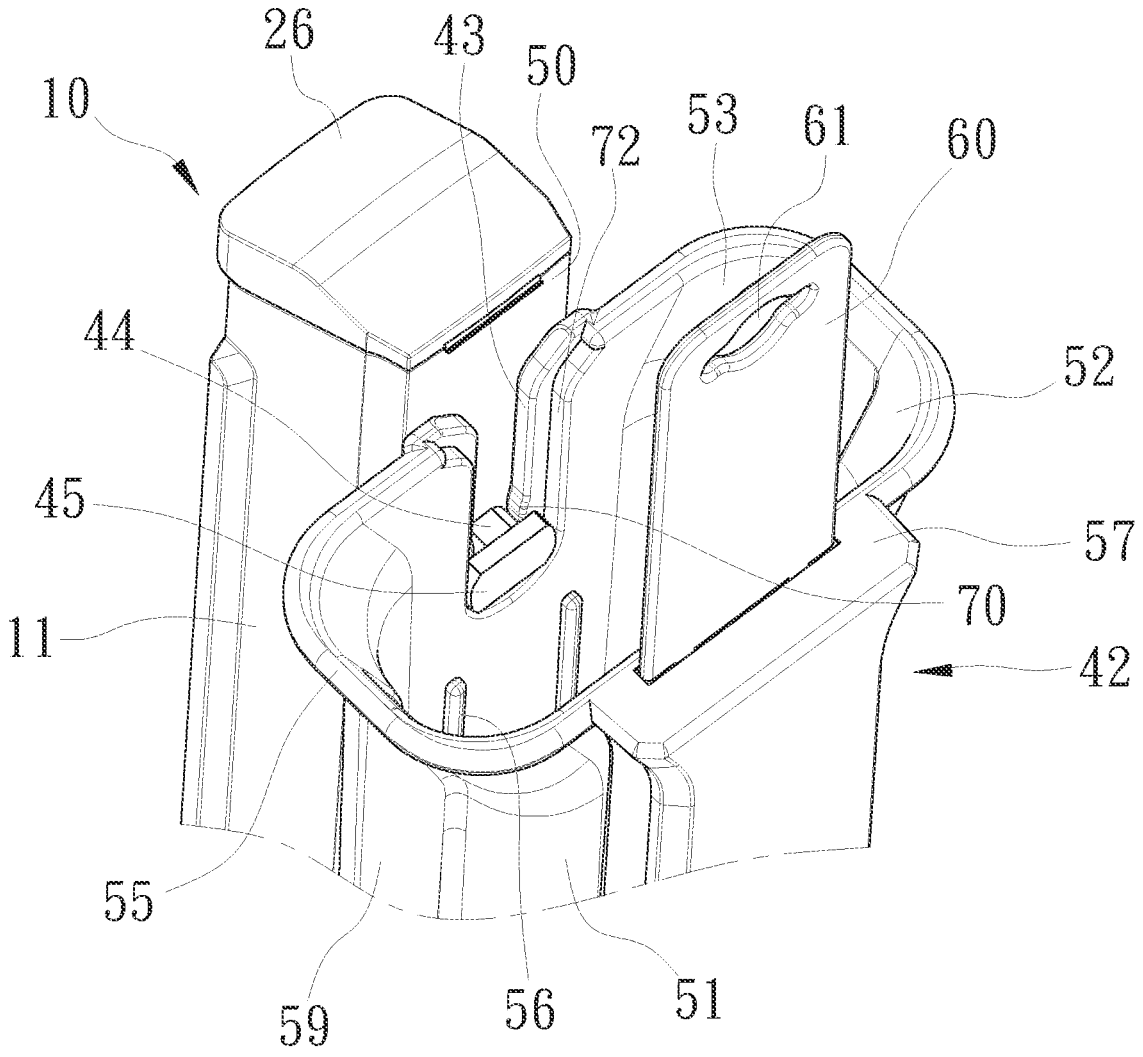
FIG. 9 is a perspective view of the blade container and the hangable sheath assembly shown in FIG. 1.

Referring to FIGS. 8 and 9, the slit 43 is made in the front portion of the sheath 51. The wing 57 is formed on the rear portion of the sheath 51. The slit 43 extends between two stepped edges 72 extending to the edge 55 and includes an open end 68 and a closed end 69. Each of the stepped edges 72 includes a protuberance 70, thereby providing a reduced section of the slit 43 near the closed end 69. The slit 43 includes a funnel-like section 71 expending toward the open end 68. The stepped edges 72 render the slit 43 a countersink hole.

The neck 44 is moved into the slit 43 via the open end 68. The funnel-like section 71 of the slit 43 renders movement of the neck 44 into the slit 43 easy. The neck 44 is moved to the closed end 69 of the slit 43 past the two protuberances 70. In an elastic manner, the two protuberances 70 keep the neck 44 in the slit 43, i.e., keep the box 11 in the sheath 51. The head 45 is flush with the stepped edges 72, i.e., the internal face of the front portion of the sheath 51.

As discussed above, the hangable sheath assembly 42, which includes the hanger 60, the sheath 51 and the blade container 10 facilitates carriage, storage and displaying of cutters.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A hangable sheath assembly comprising:

a sheath comprising a space, an opening in communication with the space, a wing extending from a portion of the sheath, a slit extending in an opposite portion of the sheath, and a slot in the wing;

an accessory comprising a neck and an enlarged head formed on the neck, wherein the neck is movable along the slit to hang the accessory on the sheath smoothly, wherein the enlarged head is inserted in the sheath while the accessory is hung on the sheath; and a hanger comprising an anchor inserted in the slot, wherein the anchor comprises a barb for abutment against the wing to keep the anchor in the slot, thereby keeping the hanger on the sheath.

2. The hangable sheath assembly according to claim 1, wherein the hanger further comprises an aperture for receiving an external object.

3. The hangable sheath assembly according to claim 1, wherein the sheath further comprises reinforcement elements extending on an internal face of the sheath.

4. The hangable sheath assembly according to claim 1, wherein the sheath further comprises a groove extending in an internal face of the sheath.

5. The hangable sheath assembly according to claim 1, wherein the sheath further comprises a reinforcement fin extending along a U-shaped edge of the sheath.

6. The hangable sheath assembly according to claim 5, wherein the sheath further comprises a groove extending in an internal face of a substantially vertical section of the reinforcement fin.

7. The hangable sheath assembly according to claim 1, wherein the sheath further comprises a clip extending from the wing.

8. The hangable sheath assembly according to claim 7, wherein the sheath further comprises a barb extending from the clip.

9. The hangable sheath assembly according to claim 1, wherein the sheath further comprises two stepped edges on two opposite sides of the slit, thereby rendering the slit countersink.

10. The hangable sheath assembly according to claim 1, wherein the slit comprises:

two protuberances extending toward each other from two opposite edges between which the slit extends, wherein the protuberances are operable to keep the neck in the slot after the neck is moved past the protuberances toward a closed end of the slot.

* * * * *